US007373695B2

(12) United States Patent
Caveney et al.

(10) Patent No.: US 7,373,695 B2
(45) Date of Patent: May 20, 2008

(54) DISPLACEMENT LOCK MLT

(75) Inventors: Jack E. Caveney, Hinsdale, IL (US); John J. Bulanda, New Lenox, IL (US); Scott R. Hartman, Oak Forest, IL (US)

(73) Assignee: Panduit Corp., Tinley Park, IL (US)

( * ) Notice: Subject to any disclaimer, the term of this patent is extended or adjusted under 35 U.S.C. 154(b) by 46 days.

(21) Appl. No.: 11/420,370

(22) Filed: May 25, 2006

(65) Prior Publication Data

US 2006/0288539 A1 Dec. 28, 2006

Related U.S. Application Data

(60) Provisional application No. 60/684,913, filed on May 26, 2005.

(51) Int. Cl.
*F16L 33/00* (2006.01)

(52) U.S. Cl. ..... 24/20 R; 24/23 W; 24/21; 140/150

(58) Field of Classification Search ..... 24/20 R, 24/23 W, 23 R, 21
See application file for complete search history.

(56) References Cited

U.S. PATENT DOCUMENTS

| | | | | |
|---|---|---|---|---|
| 1,517,515 | A | 12/1924 | McGary | |
| 3,015,865 | A * | 1/1962 | Rapuzzi | 24/21 |
| 3,067,640 | A * | 12/1962 | Lodholm | 81/9.3 |
| 3,311,957 | A * | 4/1967 | Dunn | 24/21 |
| 3,754,303 | A | 8/1973 | Pollock | |
| 3,833,969 | A | 9/1974 | Hollingsworth et al. | |
| 4,128,919 | A | 12/1978 | Bulanda et al. | |
| 4,366,602 | A | 1/1983 | Conlon et al. | |
| 4,399,592 | A | 8/1983 | Chopp, Jr. | |
| 4,473,925 | A | 10/1984 | Jansen | |
| 4,765,032 | A | 8/1988 | Fortsch | |
| 4,868,953 | A | 9/1989 | Fortsch | |
| 4,896,402 | A | 1/1990 | Jansen et al. | |
| 5,123,456 | A | 6/1992 | Jansen | |
| 5,488,760 | A | 2/1996 | Jansen | |
| 5,644,819 | A | 7/1997 | Lyons | |
| 5,694,984 | A | 12/1997 | Cheung | |
| 6,076,235 | A | 6/2000 | Khokhar | |
| 6,122,804 | A | 9/2000 | Gamaggio-Schafer | |
| 6,647,596 | B1 | 11/2003 | Caveney | |
| 6,668,427 | B2 | 12/2003 | Bulanda et al. | |

* cited by examiner

*Primary Examiner*—Robert J Sandy
(74) *Attorney, Agent, or Firm*—Robert A. McCann; Christopher S. Clancy; Aimee E. McVady

(57) ABSTRACT

A metal locking tie formed from a locking head and an elongate strap extending through the locking head. The locking head is defined by a top wall, a bottom wall and two sides. The locking head includes a strap passageway that extends through the locking head from an entrance end to an exit end. The bottom wall of the locking head has a tab that extends upwardly toward the strap passageway in the locking head. The strap has a first end, a second end, and an aperture therethrough. When the strap is positioned within the locking head the upwardly extending tab of the locking head engages the aperture in the strap. A metal locking tie tool secures the strap to the locking head by displacing a portion of the strap in the locking head.

6 Claims, 13 Drawing Sheets

DISPLACEMENT LOCK MLT

CROSS REFERENCE TO RELATED APPLICATION

This application claims priority to U.S. Provisional Application No. 60/684,913 filed May 26, 2005, the entire contents of which are hereby incorporated by reference.

FIELD OF THE INVENTION

The present invention relates to metal locking ties, and more particularly to metal locking ties with a locking mechanism that displaces the strap within the locking head to lock the strap in the locking head.

BACKGROUND OF THE INVENTION

Metallic bundling devices incorporating locking balls and roller pins have been used for bundling bales of cotton or the like since the Nineteenth Century. None of the prior devices were positive locking, i.e. depending on the orientation of the locking head, gravity could hold the ball out of locking engagement with the strap resulting in release of the tightened strap. U.S. Pat. No. 4,399,592 addressed this problem by teaching the addition of a raised portion or protuberance for deflecting the threaded strap away from the floor as the threaded strap exits the locking head. This deflection ensures that the locking ball is in continuous engagement with the threaded strap regardless of the position of the ball or the orientation of the locking head.

It would be desirable to provide a metal locking tie having a locking mechanism that does not require locking balls or roller pins to secure the strap within the locking head.

SUMMARY OF THE INVENTION

The present invention is directed toward a metal locking tie having a locking head and an elongate strap. The locking head is defined by a top wall, a bottom wall and two sides. The locking head includes a strap passageway that extends through the locking head from an entrance end to an exit end. The bottom wall of the locking head has an aperture and a tab that extends upwardly toward the strap passageway in the locking head. The strap has a first end, a second end, and an aperture therethrough. The strap is positioned within the locking head such that the upwardly extending tab of the locking head engages the aperture in the strap. The strap wraps around the objects to be bundled and reenters the locking head. Next, the assembled locking tie is positioned in a metal locking tie tool that tensions the strap and displaces a portion of the strap in the locking head to secure the strap in the locking head. After the strap is secure, the metal locking tie tool cuts the strap flush with the locking head.

DETAILED DESCRIPTION

Figure 1:
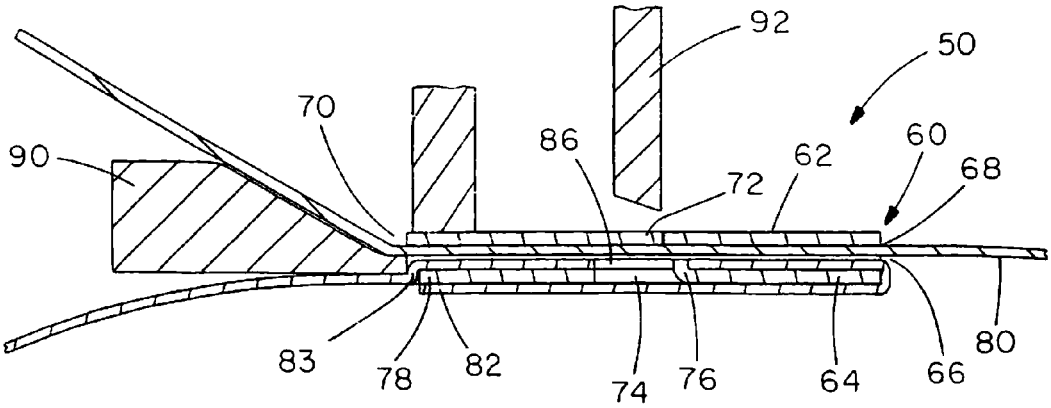
FIG. 1 is a sectional view of a first embodiment of a metal locking tie of the present invention with a cutting device engaging the strap.

The first embodiment of the metal locking tie of the present invention is illustrated in FIGS. 1-4. The metal locking tie 50 includes a metallic locking head 60 and an elongate metallic strap 80 with a first end 82 and a second end 84. The head 60 includes a top wall 62, a bottom wall 64, sides 63, 65 and a strap passageway 66 with an entrance end 68 and an exit end 70. The top wall 62 of the head 60 includes a top tab 72 positioned at the center of the head. As will be discussed below, the top tab 72 bends downward towards the strap passageway 66 in the head 60 when a locking punch 92 engages the top tab 72. The bottom wall 64 of the head 60 includes an aperture 74 positioned at the center of the head 60. The bottom wall 64 also includes a bottom tab 76 positioned adjacent to the aperture 74. The bottom tab 76 extends upwards towards the strap passageway 66.

Figure 2:
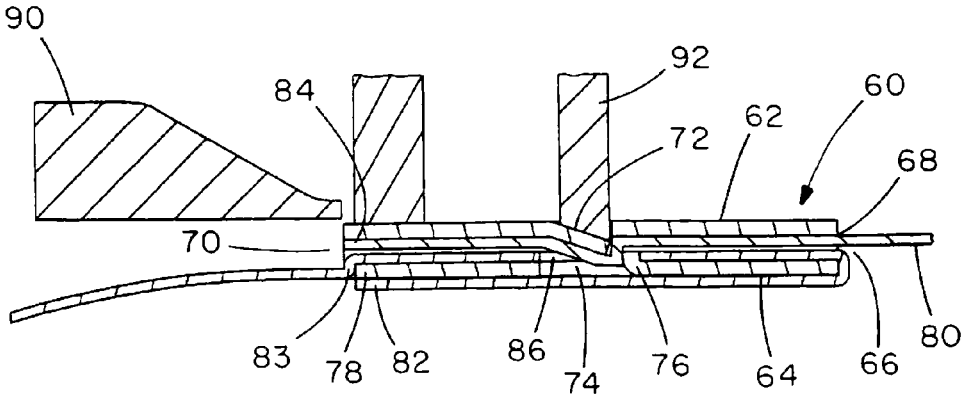
FIG. 2 is a sectional view of the metal locking tie of FIG. 1 with the cutting device activated to cut the strap and the locking punch activated to displace the strap.

As illustrated in FIGS. 1 and 2, the first end 82 of the strap 80 is positioned along the bottom wall 64 of the head 60. The strap 80 wraps around the head, through the entrance end 68 of the strap passageway 66 and extends through the strap passageway 66. The strap 80 also includes an aperture 86. The aperture 86 in the strap 80 is aligned with the top tab 72 and the aperture 74 in the bottom wall 64 of the head 60 when the strap 80 is positioned within the strap passageway 66. The bottom tab 76 engages the aperture 86 in the strap 80 when the strap 80 extends through the strap passageway 66.

Once the strap 80 has been wrapped around the objects to be held, the second end 84 of the strap 80 is inserted in the entrance end 68 of the strap passageway 66 and through the strap passageway 66. The metal locking tie tool (not shown) tensions the strap 80 and the tool is activated to secure the strap 80 to the head 60 and to cut the strap 80 (see FIG. 2).

To lock the strap 80 in the locking head 60, the locking punch 92 engages the top tab 72 in the head 60. The locking punch 92 presses the top tab 72 downwards to displace the strap 80 downward through the aperture 86 in the strap 80 into the aperture 74 in the bottom wall 64 of the head 60. As shown in FIG. 2, the displaced strap is positioned in an area behind the bottom tab 76.

Figure 3:
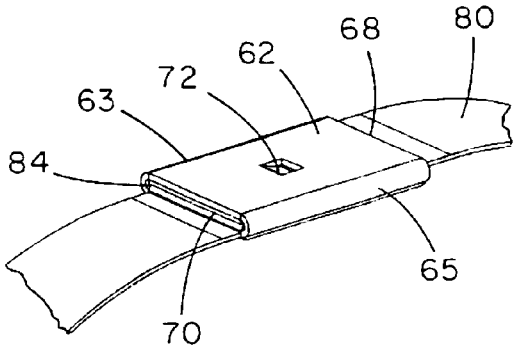
FIG. 3 is a top perspective view of the metal locking tie of FIG. 2 where the strap is secured to the head.
Figure 4:
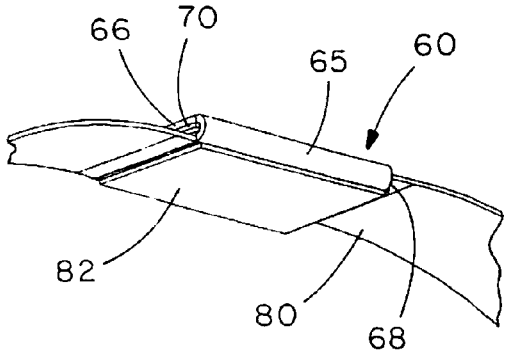
FIG. 4 is a bottom perspective view of the metal locking tie of FIG. 3.

Also illustrated in FIGS. 1 and 2, an edge 78 of the bottom wall 64 of the head 60 is slightly inset from the end of the top wall of the head. The first end 82 of the strap 80 includes an offset portion 83 that is bent around edge 78 and provides clearance for a cutoff blade 90 of a metal locking tie tool thereby allowing the cutoff blade 90 to cut the strap 80 flush with the top wall 62 of the head 60, as shown in FIG. 2. Thus, as illustrated in FIGS. 3 and 4, the strap 80 has been cut and the second end 84 of the strap 80 is secured to the head 60.

Figure 5:
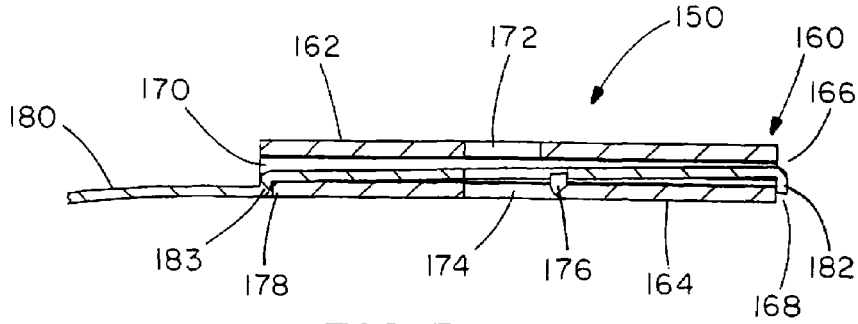
FIG. 5 is a sectional view of a second embodiment of the metal locking tie of the present invention.
Figure 6:
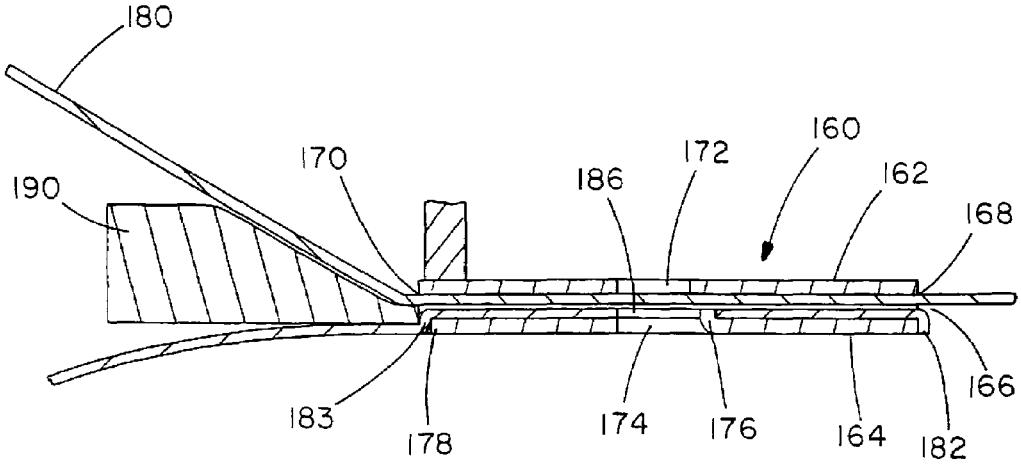
FIG. 6 is a sectional view of the metal locking tie of FIG. 5 with a cutting device engaging the strap.
Figure 7:
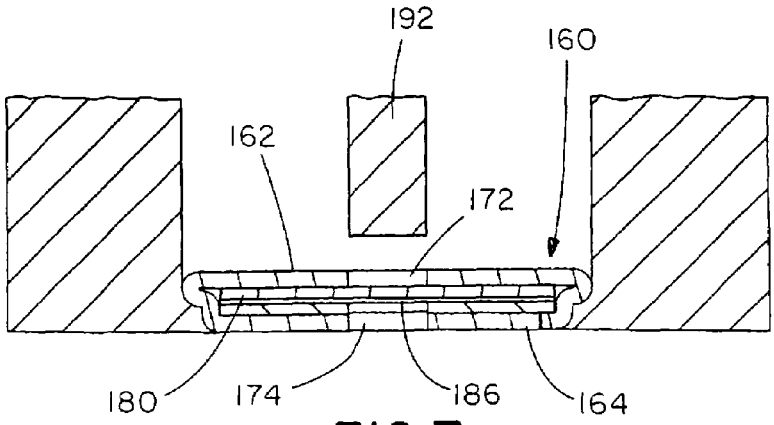
FIG. 7 is a sectional view of the metal locking tie of FIG. 5 supported in the locking tie tool before the tool is activated.

The second embodiment of the metal locking tie of the present invention is illustrated in FIGS. 5-11. As shown in FIGS. 5 and 6, the second embodiment of the metal locking tie 150 is similar to the metal locking tie 50 of the first embodiment except the locking head 160 includes a center aperture 172 in the top wall 162 instead of a top tab 72. As shown in FIGS. 5-6, the center aperture 172 in the top wall 162 is aligned with the aperture 174 in the bottom wall 164 of the head 160.

As shown in FIGS. 5-11, the first end 182 of the strap 180 engages the bottom wall 164 of the locking head 160. The first end 182 of the strap 180 is bent up to create a friction resistance with the second end 184 of the strap 180 when the second end 184 enters the strap passageway 166 in the head. In another variation of the second embodiment, as illustrated in FIGS. 12-15, the first end 182 of the strap 180 may be positioned along the bottom wall 164 of the head 160 such that the strap 180 wraps around the entrance end 168 of the strap passageway 166 and extends through the strap passageway 166.

Once the strap 180 has been wrapped around the objects to be held or bundled, the second end 184 of the strap 180 is inserted in the entrance end 168 of the strap passageway 166 and through the strap passageway 166. The metal locking tie tool tensions the strap 180 and the tool is activated (see FIGS. 8-9 and 12-13) to secure the strap 180 to the head 160 and to cut the strap 180.

Figure 8:
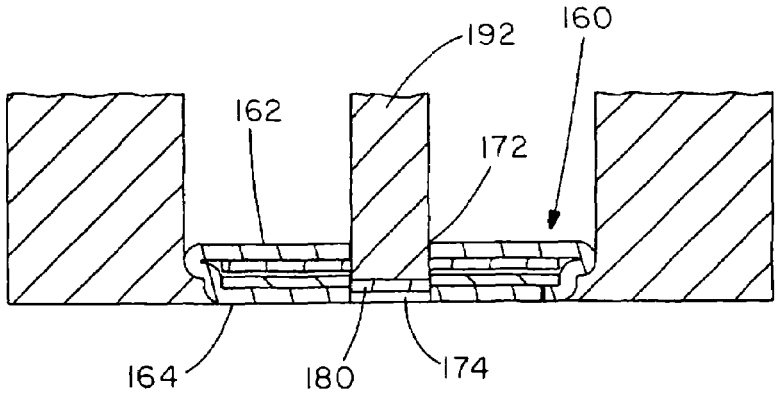
FIG. 8 is a sectional view of the metal locking tie of FIG. 7 supported in the locking tie tool after the tool has been activated.
Figure 9:
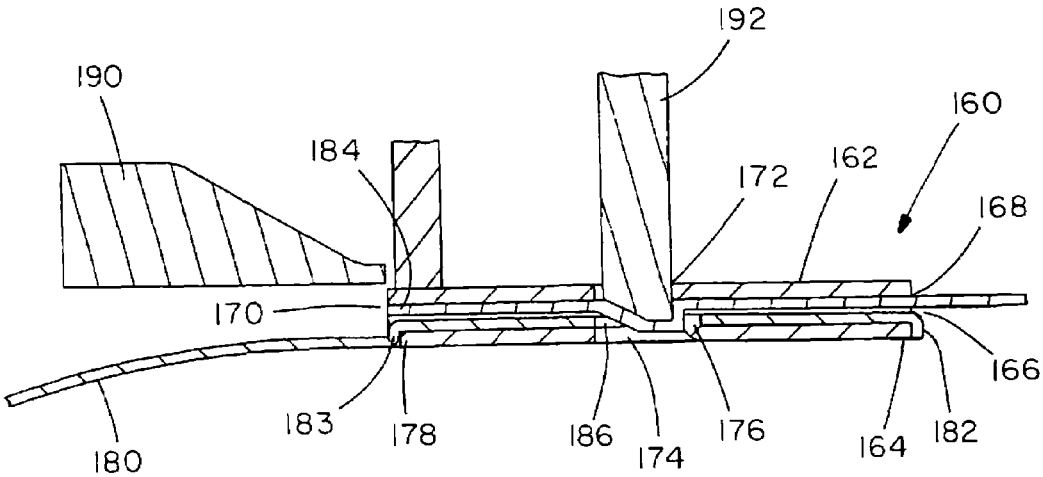
FIG. 9 is a sectional view of the metal locking tie of FIG. 5 with the cutting device activated to cut the strap and the locking punch activated to displace the strap.
Figure 10:
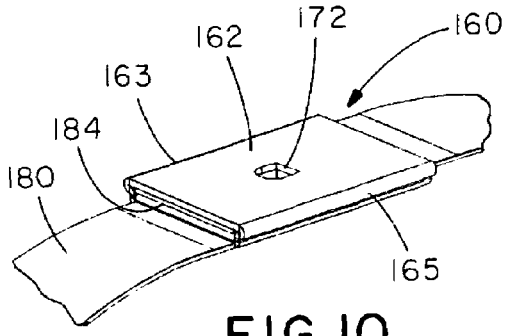
FIG. 10 is a top perspective view of the metal locking tie of FIG. 5 where the strap is secured to the head.
Figure 11:
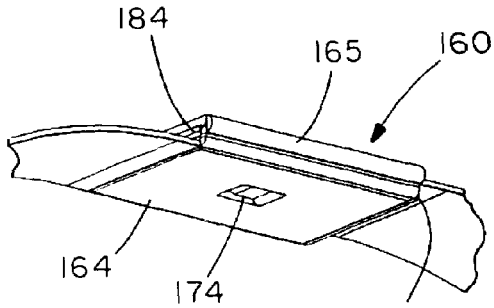
FIG. 11 is a bottom perspective view of the metal locking tie of FIG. 10.
Figure 12:
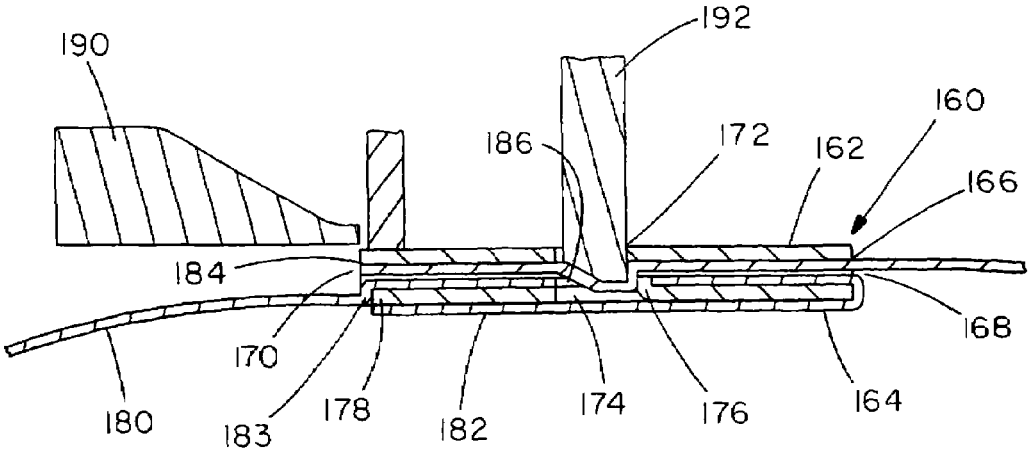
FIG. 12 is a sectional view of an alternative design of the second embodiment of the metal locking tie illustrated in FIG. 5 with the cutting device activated to cut the strap and the locking punch activated to displace the strap.
Figure 13:
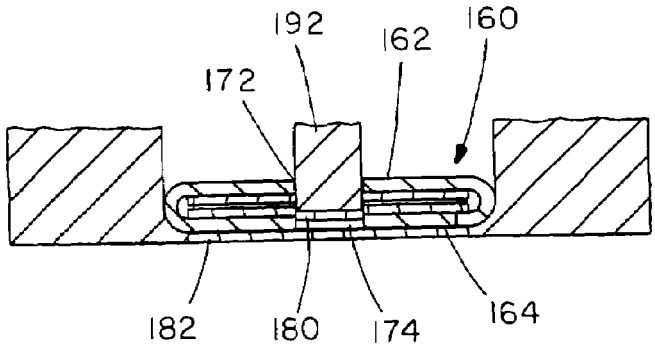
FIG. 13 is a sectional view of the metal locking tie of FIG. 12 supported in the locking tie tool after the tool has been activated.
Figure 14:
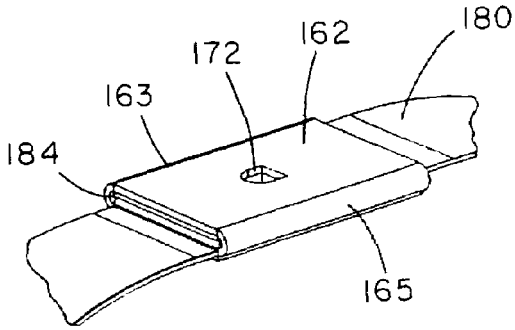
FIG. 14 is a top perspective view of the metal locking tie of FIG. 12 where the strap is secured to the head.
Figure 15:
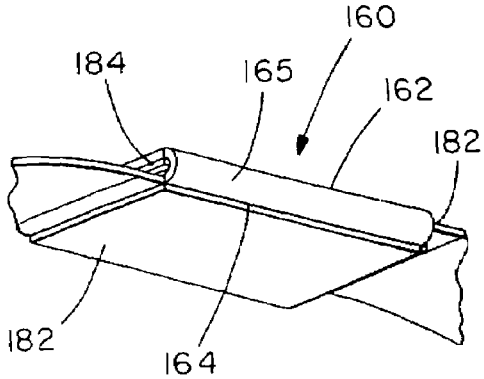
FIG. 15 is a bottom perspective view of the metal locking tie of FIG. 14.
Figure 16:
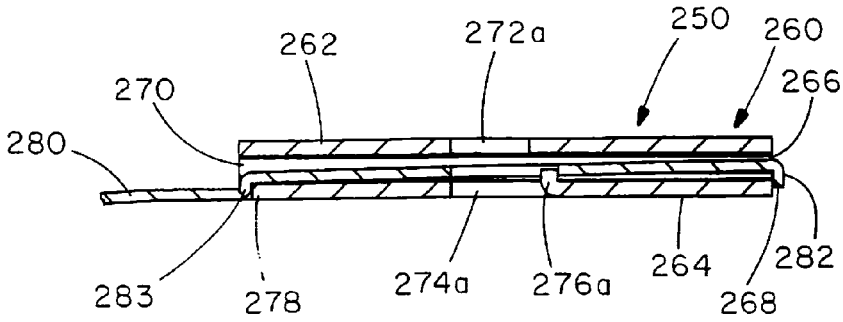
FIG. 16 is a sectional view of a third embodiment of the metal locking tie of the present invention.
Figure 17:
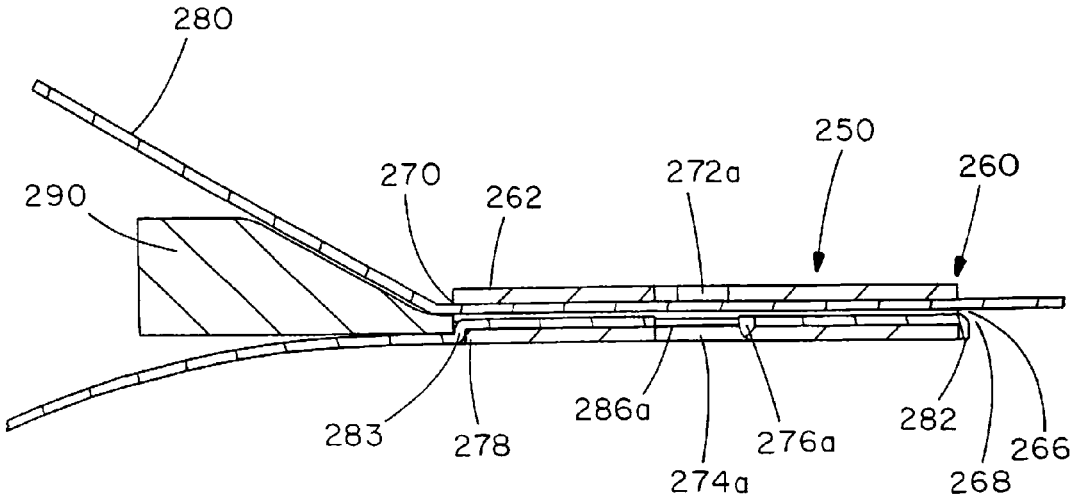
FIG. 17 is a sectional view of the metal locking tie of FIG. 16 with a cutting device engaging the strap.

As illustrated in FIGS. 8-9 and the variation of the second embodiment in FIGS. 12-13, a locking punch 192 passes through the center aperture 172 in the top wall 162 of the head 160 to engage the strap 180. The locking punch 192 presses the strap 180 to displace a portion of the strap 180 downwards through the aperture 186 in the strap into the aperture 174 in the bottom wall 164 of the head 160. The displaced strap is positioned in an area behind the bottom tab 176 of the head 160.

As with the metal locking tie 50 of the first embodiment illustrated in FIGS. 1 and 2, an edge 178 of the bottom wall 164 of the head 160 of the second embodiment is slightly inset from the end of the top wall 162 of the head 160. The first end 182 of the strap 180 includes an offset portion 183 that is bent around edge 178 and provides clearance for a cutoff blade 190 of a metal locking tie tool to allow the cutoff blade 190 to cut the strap 180 flush with the top wall 162 of the head 160. Thus, as illustrated in FIGS. 10-11 and 14-15, the strap 180 has been cut and the second end 184 of the strap 180 is secured to the head 160.

Figure 18:
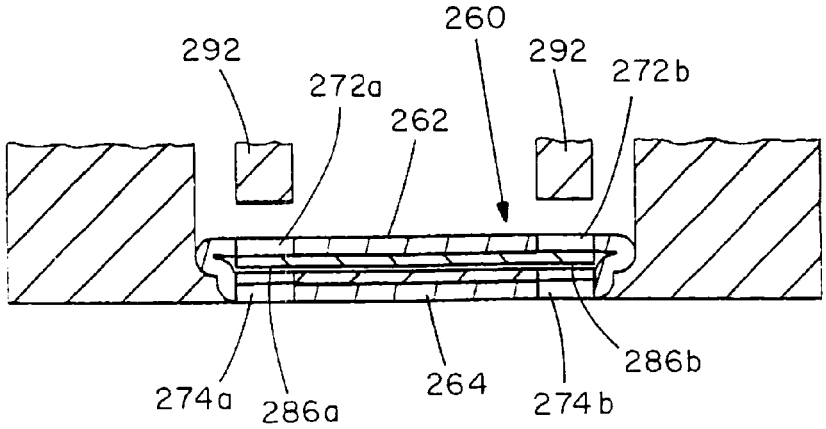
FIG. 18 is a sectional view of the metal locking tie of FIG. 16 supported in the locking tie tool before the tool is activated.
Figure 19:
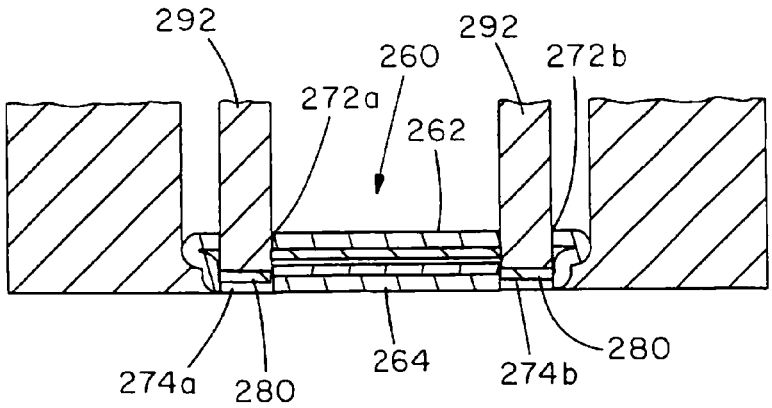
FIG. 19 is a sectional view of the metal locking tie of FIG. 16 supported in the locking tie tool after the tool has been activated.
Figure 20:
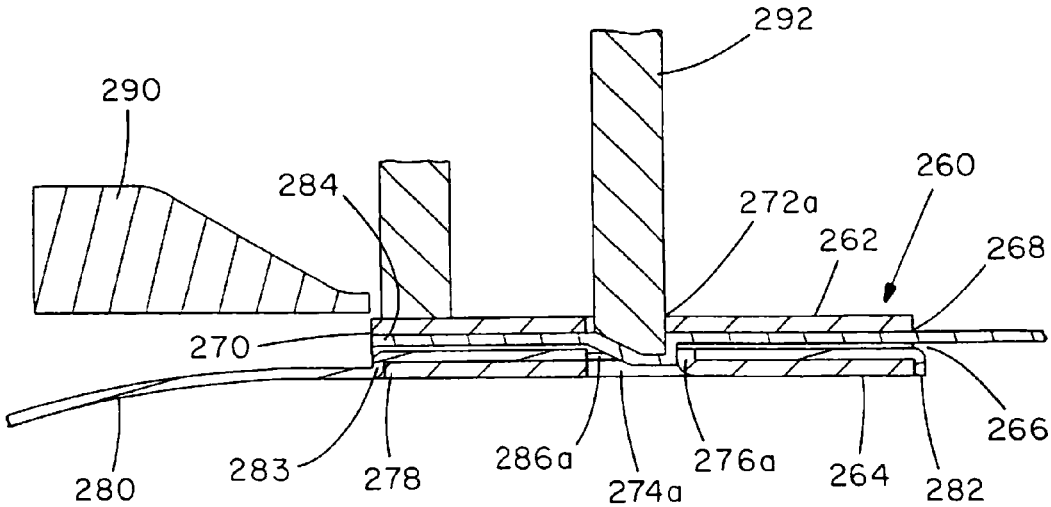
FIG. 20 is a sectional view of the metal locking tie of FIG. 16 with the cutting device activated to cut the strap and the locking punch activated to displace the strap.
Figure 21:
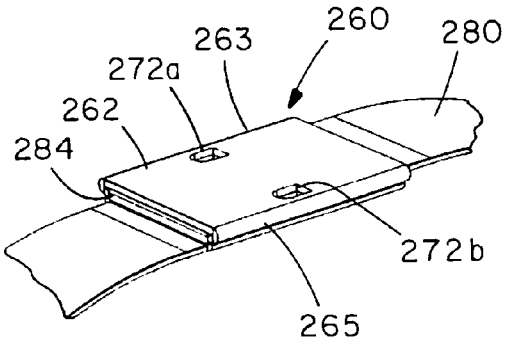
FIG. 21 is a top perspective view of the metal locking tie of FIG. 16 where the strap is secured to the head.
Figure 22:
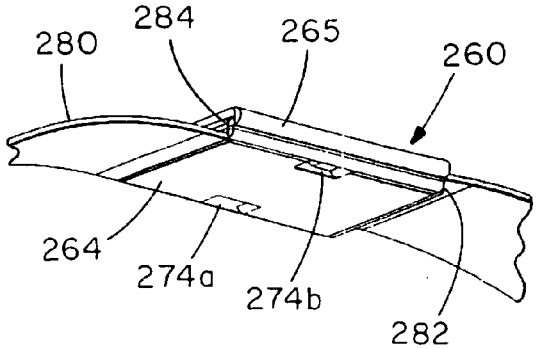
FIG. 22 is a bottom perspective view of the metal locking tie of FIG. 21.
Figure 23:
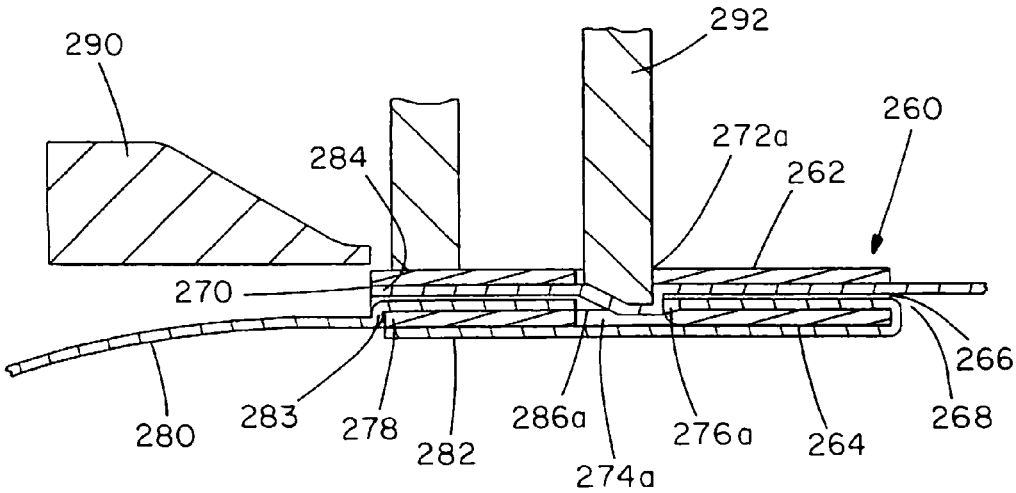
FIG. 23 is sectional view of an alternative design of the third embodiment of the metal locking tie illustrated in FIG. 16 with the cutting device activated to cut the strap and the locking punch activated to displace the strap.
Figure 24:
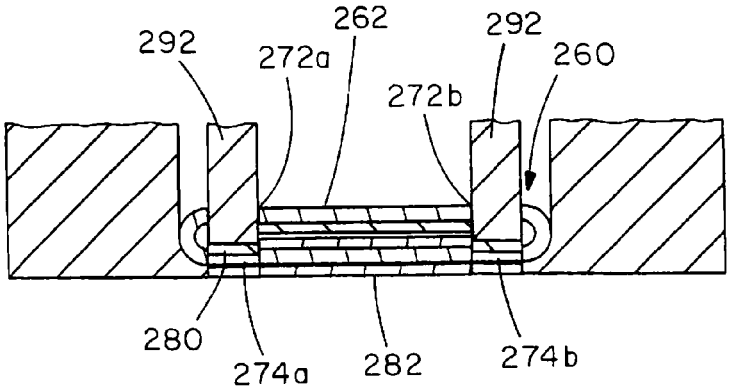
FIG. 24 is a sectional view of the metal locking tie of FIG. 23 supported in the locking tie tool after the tool has been activated.
Figure 25:
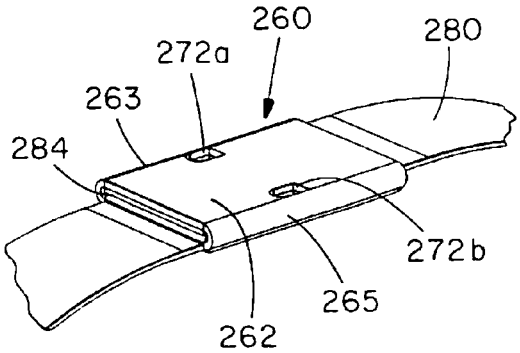
FIG. 25 is a top perspective view of the metal locking tie of FIG. 23 where the strap is secured to the head.
Figure 26:
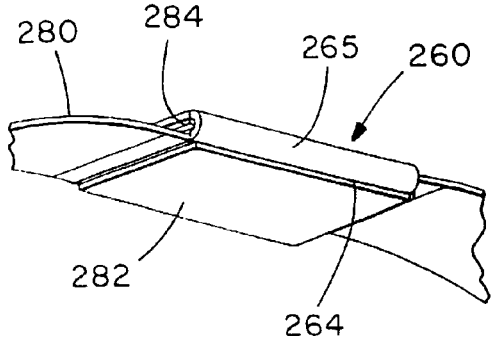
FIG. 26 is a bottom perspective view of the metal locking tie of FIG. 25.

The third embodiment of the metal locking tie 250 of the present invention is illustrated in FIGS. 16-26. The third embodiment of the metal locking tie 250 includes a locking head 260 with two apertures 272*a*, 272*b* in the top wall 262 and two apertures 274*a*, 274*b* in the bottom wall 264. As illustrated in FIG. 18, the top apertures 272*a*, 272*b* are aligned with the bottom apertures 274*a*, 274*b*. The apertures 272*a*, 272*b* and 274*a*, 274*b* are located at the middle of the head 260 near the sides of the head 260. However, the apertures 272*a*, 272*b* and 274*a*, 274*b* may be located closer to the center of the head 260. The head 260 also includes two bottom tabs 276*a*, 276*b* positioned adjacent to the bottom apertures 274*a*, 274*b* in the bottom wall 264 of the head 260. Additionally, the strap 280 includes two apertures 286*a*, 286*b*. When the strap 280 is inserted through the strap passageway 266, the apertures 286*a*, 286*b* in the strap 280 become aligned with the apertures 272*a*, 272*b* in the top wall 262 and the apertures 274*a*, 274*b* in the bottom wall 264 of the head 260.

As with the second embodiment, the first end 282 of the strap 280 may engage the bottom wall 264 of the locking head 260 (FIGS. 16-22) or the strap may be positioned along the bottom wall 264 of the head 260 such that the strap 280 wraps around the entrance end 268 of the strap passageway 266 (FIGS. 23-26).

Once the strap 280 has been wrapped around the objects to be held, the second end 284 of the strap 280 is inserted in the entrance end 268 of the strap passageway 266 and through the strap passageway 266. The metal locking tie tool tensions the strap 280 and the tool is activated (see FIGS. 19-20 and 23-24) to secure the strap 280 to the head 260 and to cut the strap 280.

To lock the strap 280 in the locking head 260, a locking punch 292 passes through the apertures 272*a*, 272*b* in the top wall 262 of the head 260 to engage the strap 280. The locking punch 292 presses the strap 280 to displace two portions of the strap 280 downwards through the strap apertures 286*a*, 286*b* into the apertures 274*a*, 274*b* in the bottom wall 274 in the head 260. The displaced strap portions are positioned in an area behind the bottom tabs 276*a*, 276*b* of the head 260.

As with the first and second embodiments, an edge 278 of the bottom wall 264 of the third embodiment of the head 260 is slightly inset from the end of the top wall 262 of the head 260. The first end 282 of the strap 280 includes an offset portion 283 that is bent around edge 278 and provides clearance for a cutoff blade 290 of a metal locking tie tool to allow the cutoff blade 290 to cut the strap 280 flush with the top wall 262 of the head 260. Thus, as illustrated in FIGS. 21-22 and 25-26, the strap 280 has been cut and the second end 284 of the strap 280 is secured to the head 260.

Figure 27:
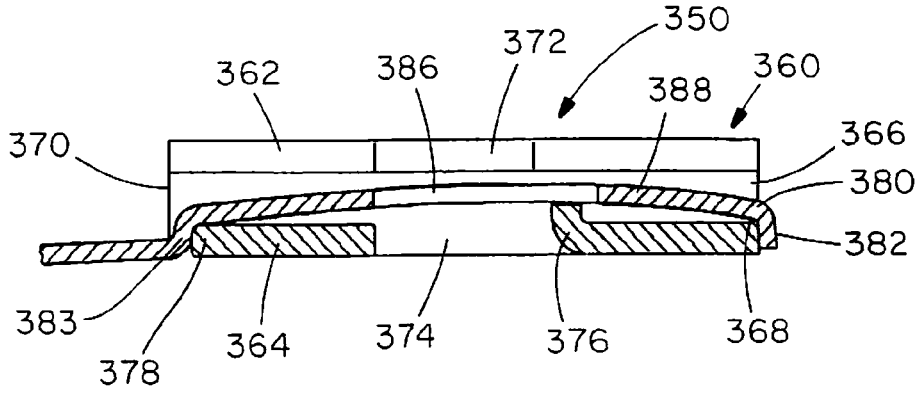
FIG. 27 is a sectional view of the metal locking tie with a portion of the strap curved upwards as the strap is being installed in the locking head.
Figure 28:
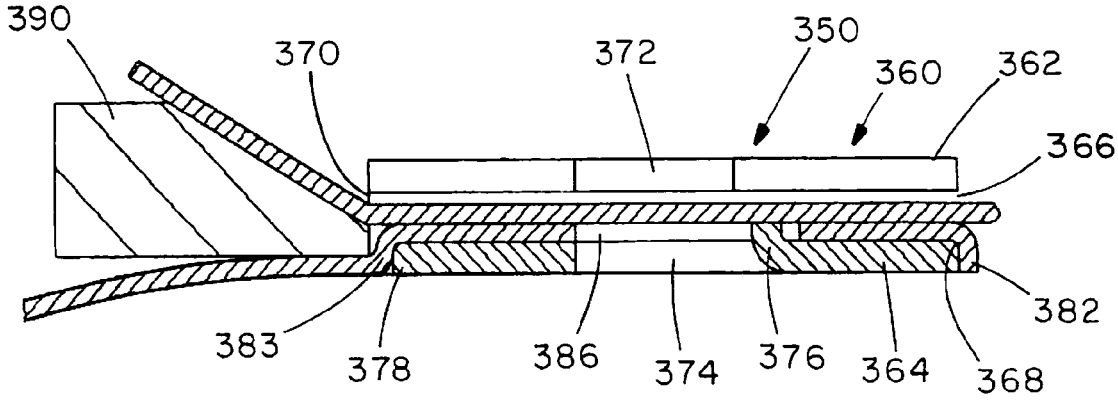
FIG. 28 is a sectional view of the metal locking tie of FIG. 27 with the cutting device engaging the strap.

FIGS. 27-31 illustrate the metal locking tie of the present invention having a metal locking head 360 and an elongated strap 380. The metal locking head 360 includes a top wall 362 with a center aperture 372 and a bottom wall 364 with an aperture 374 and a bottom tab 376. The metal strap 380 includes a first end 382, a second end 384 and an aperture 386. The aperture 386 is located near the first end 382 of the strap. As illustrated in FIG. 27, the strap 380 is inserted in the locking head 360 such that a portion of the strap 380 is curved or bent upwards toward the top wall 362 of the metal locking head 360. Once the strap is inserted in the strap passageway 366 the bottom tab 376 of the locking head 360 is positioned in the aperture 386 of the strap. As illustrated in FIGS. 27-28, the first end 382 of the strap is bent over to engage the entrance end 368 of the locking head 360. Once the strap has been wrapped around the objects to be held, the second end 384 of the strap is inserted in the entrance end 368 of the locking head 360. The curved or bent portion 388 of the strap creates a friction resistance with the second end 384 of the strap when the second end 384 of the strap passes through the strap passageway 366 in the locking head 360.

Figure 29:
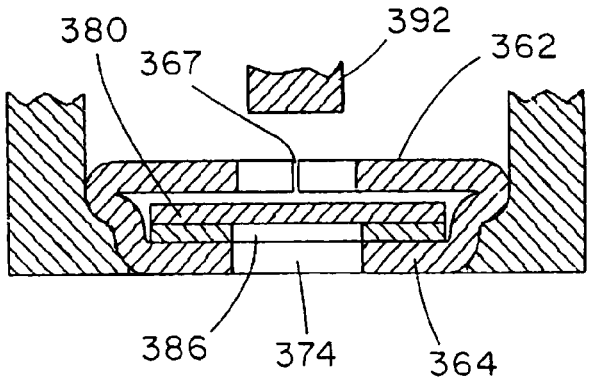
FIG. 29 is a sectional view of the metal locking tie of FIG. 27 supported in the locking tie tool before the tool is activated.
Figure 30:
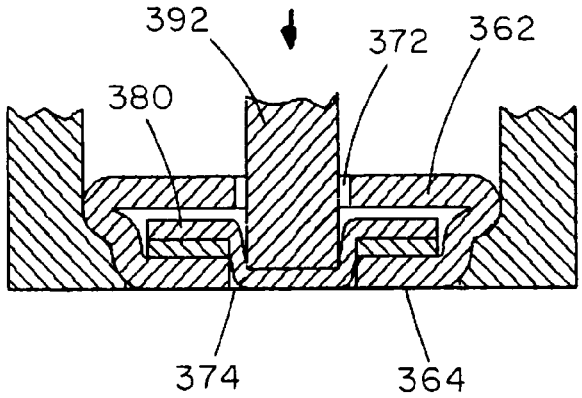
FIG. 30 is a sectional view of the metal locking tie of FIG. 29 supported in the locking tie tool after the tool has been activated.
Figure 31:
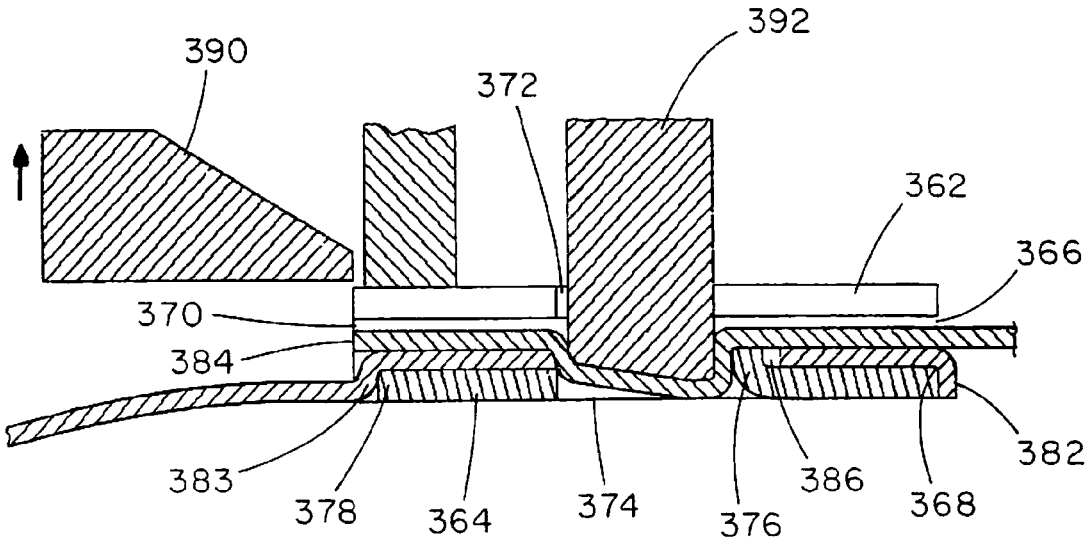
FIG. 31 is a sectional view of the metal locking tie of FIG. 27 with the cutting device activated to cut the strap and the locking punch activated to displace the strap.

FIG. 29 illustrates the locking head with a slot 367 at the center of the locking head 360. As discussed above, a metal locking tie tool tensions the strap, secures the strap to the head and cuts the strap. The locking head 360 is positioned in the metal locking tie tool so that the locking punch 392 may pass through the center aperture 372 to displace a portion of the strap 380 through the aperture 386 in the strap 380 into the aperture 374 in the bottom wall 364 of the locking head 360. As illustrated in FIG. 31, the displaced portion of the strap is positioned in an area behind the bottom tab 376.

As with the metal locking tie illustrated and discussed above, an edge 378 of the bottom wall 364 of the locking head 360 is slightly inset from the end of the top wall of the head. The first end 382 of the strap 380 includes an offset portion 383 that is bent around edge 378 and provides clearance for a cutoff blade 90 of a metal locking tie tool to enable the cut off blade 390 to cut the strap 380 flush with the top wall 362 of the locking head 360.

As discussed above, the first end 382 of the strap 380 may also be positioned along the bottom wall 364 of the head 360 such that the strap 380 wraps around the entrance end 368 of the locking head 360 and extends through the strap passageway 366.

Additionally, the metal locking tie illustrated in FIGS. 27-31 may also be designed with the locking head having two apertures in the top wall and two apertures in the bottom wall and the strap 380 having two apertures as illustrated in FIGS. 16-26.

Figure 32:
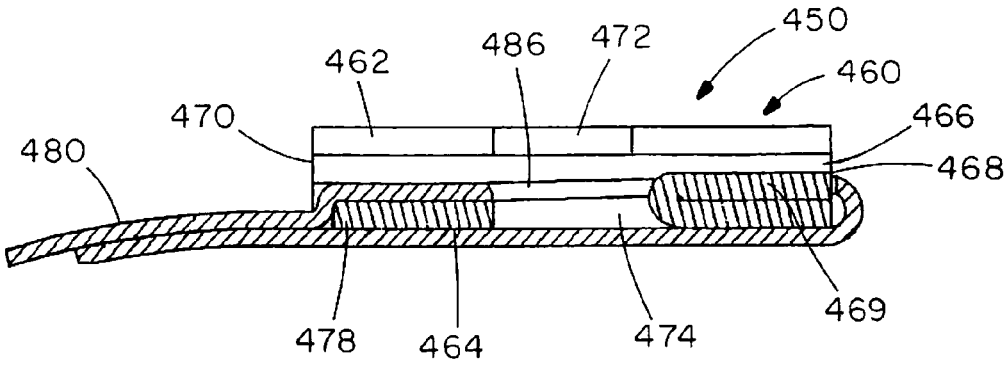
FIG. 32 is a sectional view of the metal locking tie of the present invention with the locking head having a fold over tab.
Figure 33:
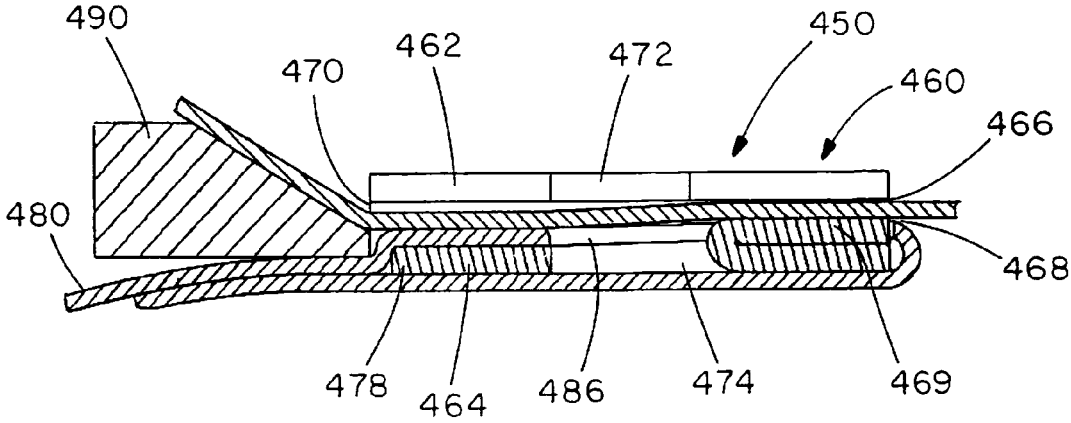
FIG. 33 is a sectional view of the metal locking tie of FIG. 32 with a cutting device engaging the strap.
Figure 34:
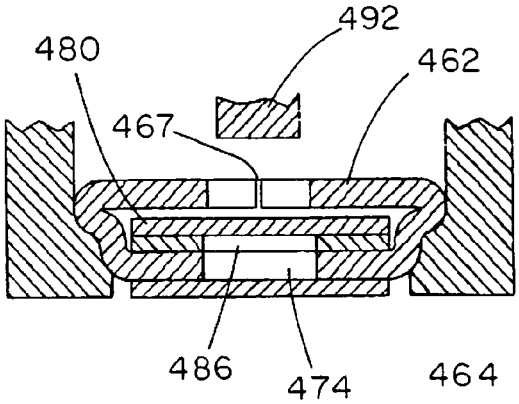
FIG. 34 is a sectional view of the metal locking tie of FIG. 32 supported in the locking tie tool before the tool has been activated.
Figure 35:
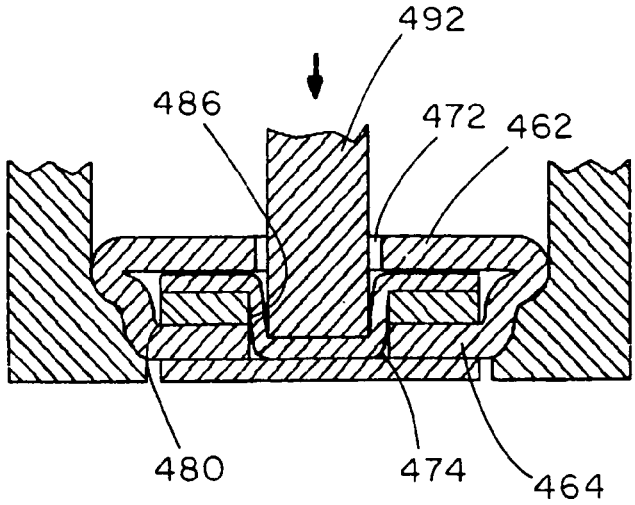
FIG. 35 is a sectional view of the metal locking tie of FIG. 34 supported in the locking tool after the tool has been activated.
Figure 36:
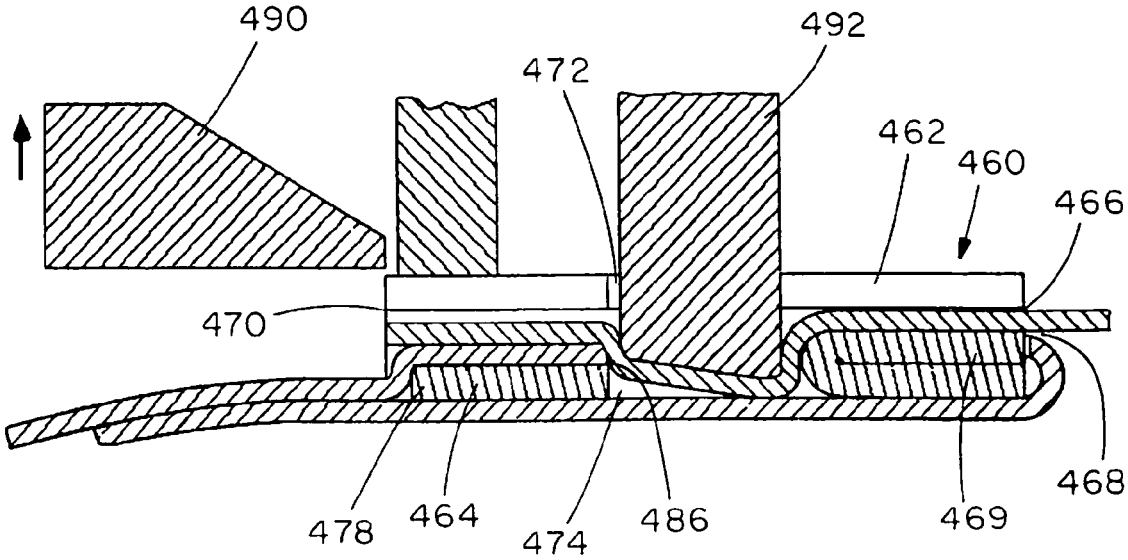
FIG. 36 is a sectional view of the metal locking tie of FIG. 32 with the cutting device activated to cut the strap and the locking punch activated to displace the strap.

FIGS. 32-36 illustrate the metal locking tie of the present invention with a metal locking head 460 having a fold-over tab 469. The fold over tab 469 is formed by bending back part of the bottom wall 464. As shown in FIGS. 32 and 33, the fold over tab 469 extends from opening 474 to the entrance end 468 of strap passageway 466. The fold over tab of this embodiment provides an impeded insertion surface for strap 480 as it reenters the entrance end 468 of locking head 460 after being installed around a bundle.

As described above, to secure the strap to the locking head, the locking head 460 is positioned in the metal locking tie tool so that the locking punch 492 may pass through the center aperture 472 of the locking head 460. The locking punch 492 displaces a portion of the strap 480 through the aperture 486 in the strap into the aperture 474 in the bottom wall 464 of the locking head 460 thereby securing the strap 480 in the locking head 460. Once the strap is secured, the cut off blade 490 cuts the strap 480 flush with the top wall 462 of the locking head 460.

Figure 37:
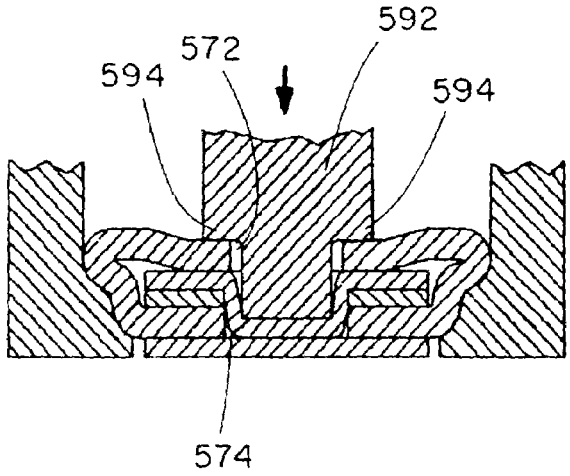
FIG. 37 is a sectional view of the metal locking tie of FIGS. 12-15 supported in an alternative metal locking tie tool having a locking punch with shoulders.
Figure 38:
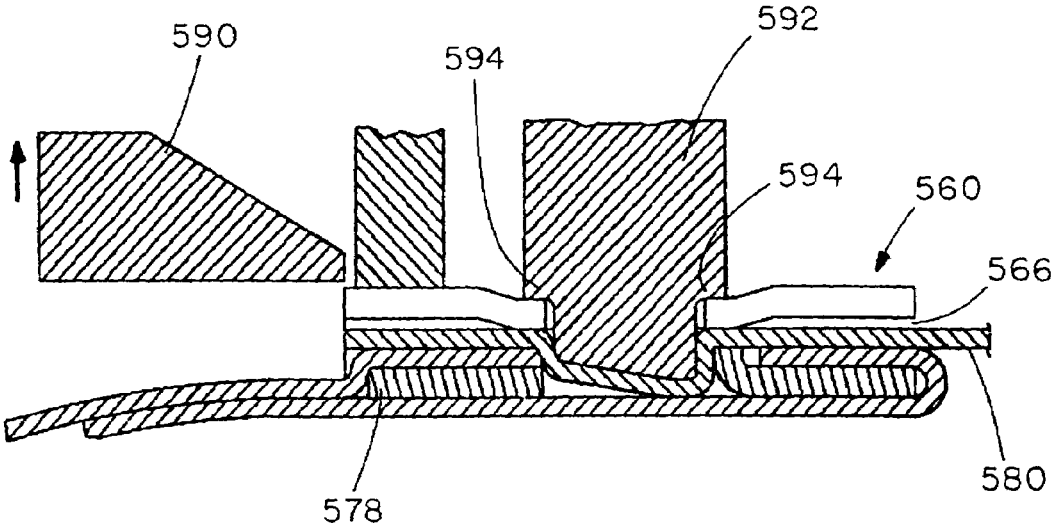
FIG. 38 is a sectional view of the metal locking tie of FIG. 37 with the cutting device activated to cut the strap and the locking punch activated to displace the strap.

As illustrated in FIGS. 37-40, the metal locking tie tool may include a locking punch having a shoulder located on each side of the punch near the bottom of the punch. FIGS. 37-38 illustrate a locking punch 592 with shoulders 594 engaging a locking head 560 having one aperture 572 in the top wall and one aperture 574 in the bottom wall. When the metal locking tie tool is activated, the shoulders 594 of the punch 592 deform the metal locking head 560 and close the gap between the locking head 560 and the strap 580 positioned therein. The shouldered punch 592 creates a multi-directional deformation of the locking head surface thereby securing the strap in the locking head.

Figure 39:
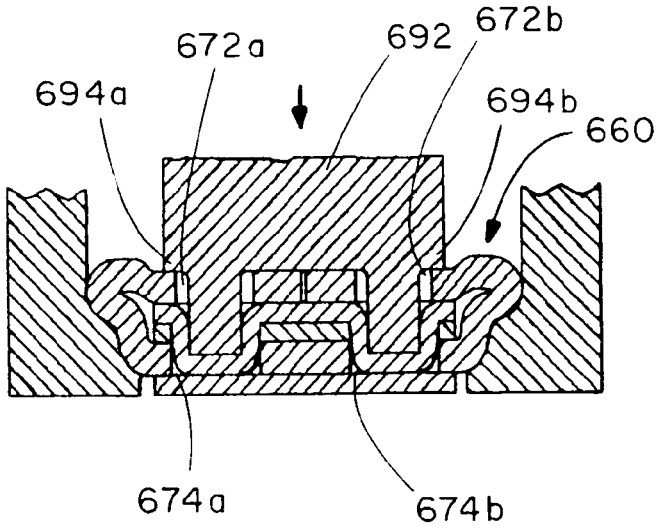
FIG. 39 is a sectional view of the metal locking tie of FIGS. 23-26 supported in an alternative metal locking tie tool having a locking punch with shoulders.
Figure 40:
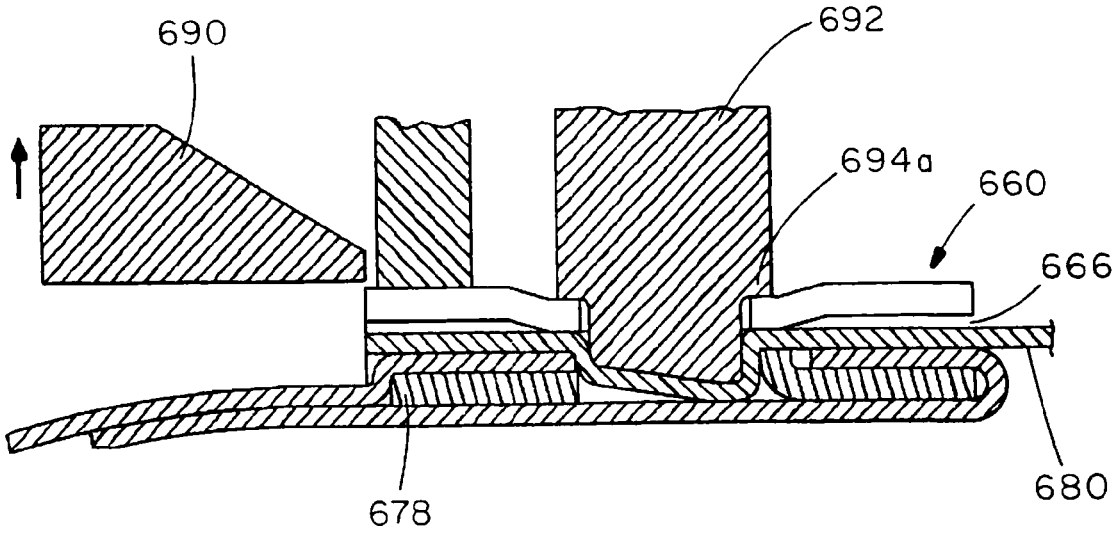
FIG. 40 is a sectional view of the metal locking tie of FIG. 39 with the cutting device activated to cut the strap and the locking punch activated to displace the strap.

FIGS. 39-40 illustrate a locking punch 692 with shoulders 694*a*, 694*b* engaging a locking head having two apertures

672*a*, 672*b* in the top wall and two apertures 674*a*, 674*b* in the bottom wall. As with the shoulder locking punch 592 illustrated in FIGS. 37-38, the shoulders 694*a*, 694*b* of the locking punch 692 deform the locking head 660 and close the gap between the strap 680 and the locking head 660 thereby securing the strap 680 in the locking head 660.

The locking head and strap of the present invention are preferably formed of stainless steel to allow the strap to be used over a wide temperature range and to give the cable tie high strength and excellent resistance to corrosion. Additionally, as known in the art, the strap may be partially coated for increased abrasion resistance and the locking head may be heat treated for increased strength. Also, as is well known in the art, the first end of the strap may be welded to the locking head.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A method of securing a metal locking tie around a bundle of objects, the method comprising:

providing a locking head and a strap, the locking head having a top wall, a bottom wall and sides and a strap passageway having an entrance end and an exit end, the strap having a first end secured to the locking head, a second end and an aperture near the first end of the strap;

wrapping the second end of the strap around a bundle of objects;

inserting the second end of the strap through the strap passageway in the locking head; and displacing a portion of the second end of the strap in the locking head with a locking punch having at least one shoulder for deforming the locking head thereby closing any gap between the locking head and the strap.

2. The method of claim 1, further comprising the step of cutting the strap flush with the exit end of the locking head.

3. The method of claim 1, wherein the strap includes a portion of the strap within the strap passageway curved upwardly towards a top wall of the locking head.

4. The method of claim 1, wherein the top wall of the locking head has at least one aperture, the aperture in the strap being generally positioned under the aperture in the head.

5. The method of claim 1, whereby the displaced portion of the strap extends through the aperture in the strap.

6. The method of claim 1, wherein the bottom wall of the locking head has at least one aperture, whereby the displaced portion of the strap extends through the aperture in the bottom wall.

* * * * *